US006317097B1

(12) United States Patent
Smith

(10) Patent No.: US 6,317,097 B1
(45) Date of Patent: Nov. 13, 2001

(54) CAVITY-DRIVEN ANTENNA SYSTEM

(75) Inventor: Stephen H. Smith, Leucadia, CA (US)

(73) Assignee: Smith Technology Development, LLC, San Diego, CA (US)

( * ) Notice: Subject to any disclaimer, the term of this patent is extended or adjusted under 35 U.S.C. 154(b) by 0 days.

(21) Appl. No.: 09/436,144

(22) Filed: Nov. 9, 1999

Related U.S. Application Data

(60) Provisional application No. 60/145,744, filed on Nov. 9, 1998.

(51) Int. Cl.[7] ..... H01Q 13/00
(52) U.S. Cl. ..... 343/789; 343/786; 343/895
(58) Field of Search ..... 343/786, 789, 343/895, 756; H01Q 13/02, 13/00

(56) References Cited

U.S. PATENT DOCUMENTS

| | | | |
|---|---|---|---|
| 2,495,399 | 1/1950 | Wheeler . | |
| 3,417,403 | 12/1968 | Fenwick . | |
| 3,680,138 | 7/1972 | Wheeler | 343/756 |
| 4,442,438 | 4/1984 | Siwiak et al. . | |
| 4,494,117 | 1/1985 | Coleman . | |
| 5,041,842 | 8/1991 | Blaese . | |
| 5,233,364 | 8/1993 | Lefeuvre et al. | 343/789 |
| 5,694,140 | 12/1997 | Waterman et al. . | |
| 5,708,448 | 1/1998 | Wallace . | |

*Primary Examiner*—Michael C. Wimer
(74) *Attorney, Agent, or Firm*—Kenyon & Kenyon

(57) ABSTRACT

An electromagnetic wave is transmitted from and received by an antenna system having a cavity member, a passive antenna element and a driver element. The cavity member has a back portion and a wall portion which define a substantially cylindrical interior portion. The antenna element has a first end disposed within the interior portion of the cavity member. The driver element is coupled to the interior portion of the cavity member.

23 Claims, 7 Drawing Sheets

CAVITY-DRIVEN ANTENNA SYSTEM

This application claims priority to U.S. Provisional application Ser. No. 60/145,744 filed Nov. 9, 1998, and incorporated herein by reference in its entirety.

CROSS-REFERENCE TO RELATED APPLICATIONS

This application is related to U.S. patent application Ser. No. 08/853,833, entitled "Communications System" and filed on May 9, 1997 and U.S. patent application Ser. No. 09/064,525, entitled "Communications System" and filed on Apr. 23, 1998, the entire contents of which are hereby incorporated by reference.

This application is related to the subject matter of the following U.S. applications filed concurrently: U.S. patent application Ser. No. 09/436236 "Adjustable Balanced Modulator," U.S. patent application Ser. No. 09/436763 entitled "System For Measuring and Displaying Three-Dimensional Characteristics of Electromagnetic Waves," U.S. patent application Ser. No. 09/436763 entitled "A Method and Apparatus For Two Dimensional Filtering," in a "Communications System Using a Transformer System," U.S. patent application Ser. No. 09/437892. entitled "Disc Antenna System," and U.S. patent application Ser. No. 09/436400 entitled "Two-Dimensional Amplifier".

BACKGROUND OF THE INVENTION

The present invention relates generally to antenna systems. More specifically, the present invention relates to a cavity-driven antenna system having a passive antenna element.

The purpose of an antenna system is to radiate efficiently the power supplied to it in the form of an electromagnetic wave. Some of the simplest known antenna systems include a single antenna element which is driven with a current to transmit an electromagnetic wave at the wavelength of the applied current. Known antenna elements include, for example, a dipole, a quarter-wave monopole, a helix, a spiral and a loop.

Antenna systems may also be required to concentrate the radiated power (i.e., the propagated electromagnetic wave) in a given direction and to minimize the radiated power in other directions. To achieve such directionality often requires a complicated antenna system that incorporates a number of individual antenna elements (e.g., an array configuration) and/or the addition of a reflector or cavity. For example, an antenna system comprising a helix antenna element within a relatively long, extended cavity has better directionality than a helix antenna alone because the cavity can suppress the side-lobes (i.e., off-axis radiated power normally present in an antenna pattern) normally present with a helix antenna alone.

FIG. 1 illustrates a cross-section view of a known antenna system having a helix antenna element within an extended cavity. The antenna system 10 has an antenna element 11 disposed within a cavity 12. The antenna element 11 is driven by a current from a power source 13. The cavity has an extended length to provide additional directivity; the length of the cavity is extended in the sense that it is typically longer than several wavelengths of the antenna system. The extended length of the cavity suppresses the propagation of side-lobes in the antenna pattern.

Although known antenna systems can provide some level of directionality, such systems suffer several shortcomings.

For example, the use of an extended cavity adds to the weight, size and cost associated with the antenna system. Antenna systems that use multiple antenna elements, for example, in an array configuration again add to the cost and complexity associated with the antenna system.

SUMMARY OF THE INVENTION

The antenna system of the present invention overcomes the shortcomings of the known antenna systems by providing improved directivity. An electromagnetic wave can be transmitted from and received by an antenna system having a cavity member, a passive antenna element and at least one driver element. The cavity member has a back portion and a wall portion which define a substantially cylindrical interior portion. The passive antenna element has a first end disposed within the interior portion of the cavity member. The driver element is coupled to the interior portion of the cavity member rather than being directly connected to the passive antenna element.

In one embodiment, a driver element is driven with a current by a power source to produce an electromagnetic field, where the driver element is coupled to an interior portion of a cavity member. The electromagnetic field can be coupled into an antenna element having a first end disposed within the interior portion of the cavity to transmit an electromagnetic wave.

DETAILED DESCRIPTION

Figure 1:
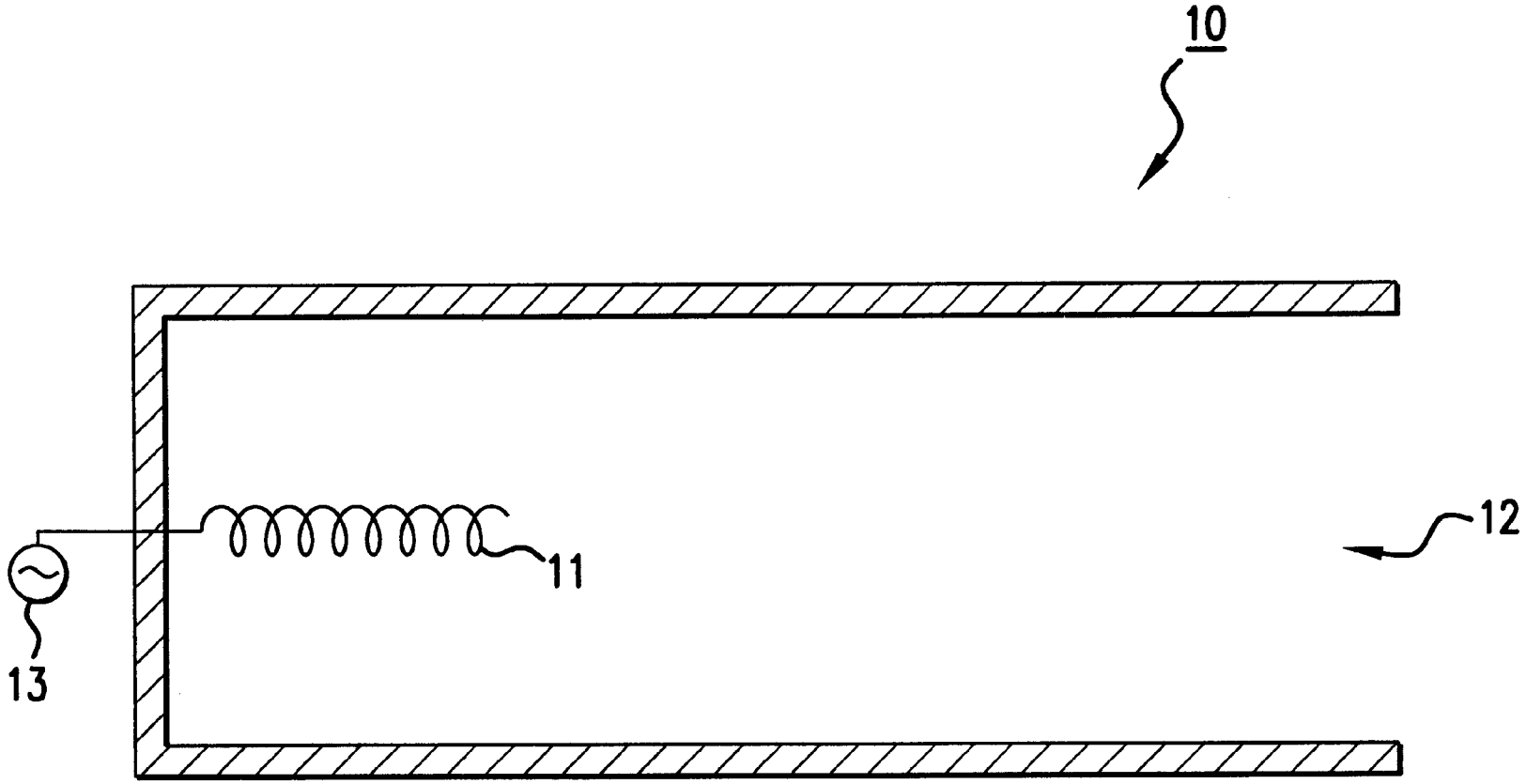
FIG. 1 (PRIOR ART)
FIG. 1 illustrates a cross-section view of a known antenna system.
Figure 2:
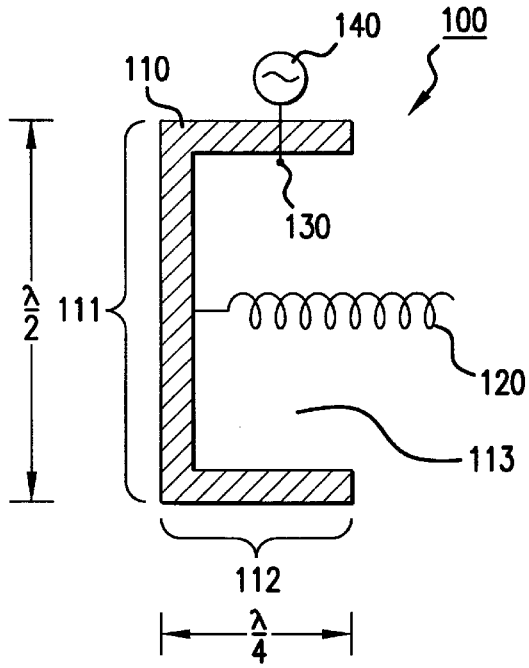
FIG. 2 illustrates a cross-section side view of an antenna system, according to an embodiment of the present invention.
Figure 3:
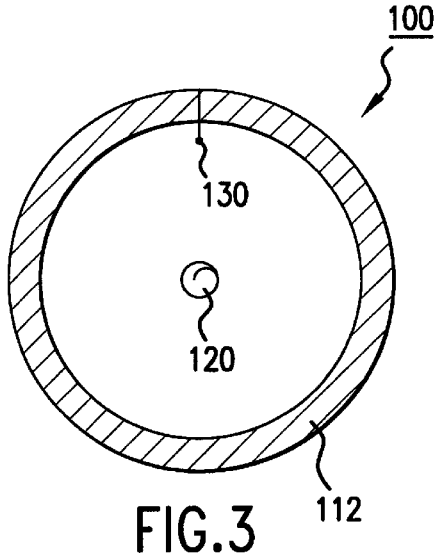
FIG. 3 illustrates an end view of the antenna system shown in FIG. 2.

Referring now in detail to the drawings wherein like parts are designated by like reference numerals throughout, FIG. 2 illustrates a cross-section side view of an antenna system, according to an embodiment of the present invention. FIG. 3 illustrates an end view of the antenna system shown in FIG. 2. In this embodiment, the antenna system includes a stub probe. More specifically, as shown in FIGS. 2 and 3, the antenna system 100 has a cavity member 110, an antenna element 120, a driver element 130 and a power Source 140. Cavity member 110 includes a back portion 111 and a wall portion 112 which define an interior portion 113.

The antenna element 120, for example, can be a helix of dimension and materials typical for a helix antenna at the operational frequency and environment of interest. For example, for the helix antenna to operate as in an axial mode (i.e., analogous to an endfire mode), the diameter of the helix and the spacing between each turn of the helix can be large fractions of the wavelength; the circumference of the turns can be substantially equal to the wavelength. Deviation from "equal" is possible, but the greater the deviation, the more likely there will be less than optimal performance. The pitch angle of the turns in the helix can be, for example, between 12 degrees and 14 degrees. Alternatively, the antenna element 120 can be a spiral.

The antenna element 120 is at least partially disposed within interior portion 113 of cavity member 110. Antenna element 120 can be disposed substantially along the longitudinal axis of the cavity member. Although antenna element 120 need not be connected to cavity member 110, antenna element 120 can be connected to cavity member 110 substantially at the center of back portion 111 of cavity member 110 to fix the position of antenna element 120 within the interior portion 113. In other words, antenna element 120 can be disposed within interior portion 113 of cavity member 110 by other mechanisms, such as a support member (not shown) attaching antenna element 120 to wall portion 112 of cavity member 110.

The cavity member 110 includes the back portion 111 and wall portion 112 which define a substantially cylindrical interior portion 113. The back portion 111 can act as a ground plane for the antenna element 120. The back portion can have, for example, a diameter of approximately one-half of the wavelength. The wall portion 112 can be connected to back portion 111 along the perimeter of back portion 111. The wall portion 112 can have, for example, a length of approximately one-quarter of the wavelength.

The interior portion 113 defined by back portion 111 and wall portion 112 is substantially cylindrical in the sense that the interior portion has a shape acting as a cylindrical waveguide producing the fundamental mode (i.e., $TE_{11}$) at the wavelengths of operation. Although the wall portion 112 is shown as being perpendicular to the back portion 111 to form a cylindrical cavity, other cavity configurations are possible such as a frustrum cavity which allow the interior portion 113 to act as a cylindrical waveguide producing the fundamental mode at the wavelengths of operation.

The driver element 130 can be coupled to the interior portion 113 of cavity member 110 and can be coupled to power source 140 because the driver element 130 is an active component. In other words, the power source 140 drives the driver element 130 with a current having a wavelength that defines the wavelength of the electromagnetic wave to be propagated by the antenna system 100. The driver element 130 can be any type of probe that when receiving a current from the power source 140 produces an electromagnetic field within the interior portion 113 of the cavity member 110. For example, the driver element 130 can be a stub probe or a loop probe located within the interior portion 113 near the perimeter of the cavity member 110. In the embodiment shown in FIGS. 2 and 3, the driver element 130 is located on the wall portion 112 of the cavity member 110 and extended into the interior portion 113.

The driver element 130 should extend into the interior portion 113 of the cavity member 110 sufficiently to effectively establish the electromagnetic field appropriate for the antenna system 110. For example, where the driver element 130 is a stub probe, its length typically can be much less one-half of the wavelength.

Figure 4:
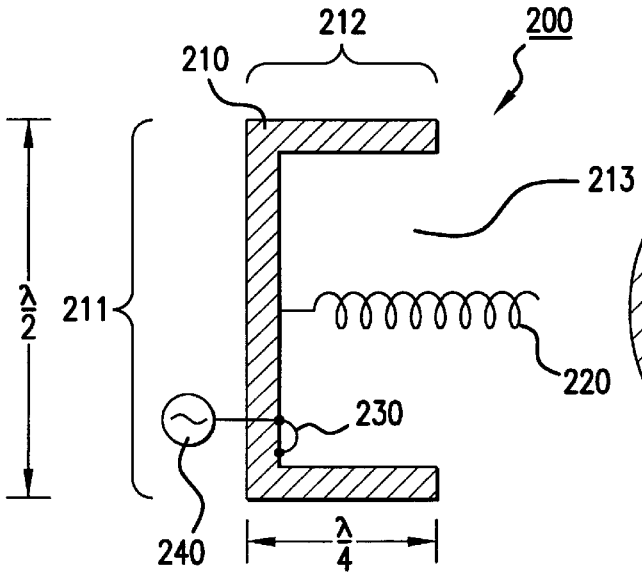
FIG. 4 illustrates a cross-sectional side view of an antenna system, according to another embodiment of the present invention.
Figure 5:
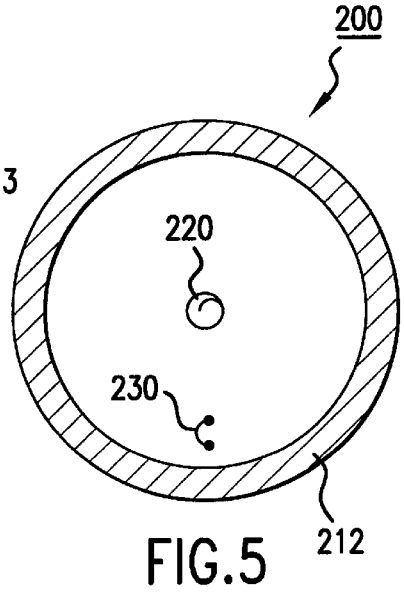
FIG. 5 illustrates an end view of the antenna system shown in FIG. 4.

FIG. 4 illustrates a cross-sectional side view of an antenna system having a loop probe, according to an embodiment of the present invention. FIG. 5 illustrates an end view of the antenna system shown in FIG. 4. The antenna system 200 shown in FIGS. 4 and 5 has a cavity member 210, an antenna element 220, a driver element 230 and a power source 240. Cavity member 210 includes a back portion 211 and a wall portion 212 which define an interior portion 213. The driver element 230 is a loop probe located on the back portion 212 near the perimeter of cavity member 210.

Returning for convenience to the embodiment of the present invention shown in FIGS. 2 and 3, once the electromagnetic field is established within the interior portion 113 of the cavity member 110 by the power source 140 driving driver element 130, the electromagnetic field is coupled into the antenna element 120. Once the electromagnetic field is coupled into the antenna element 120, an electromagnetic wave can be transmitted by antenna element 120.

Where the antenna element 110 is a helix, the electromagnetic wave transmitted by antenna element 120 will be a circularly polarized wave rotating in the direction corresponding to the direction of the turns of antenna element 120. For example, if the helix of antenna element 110 has clockwise turns, the transmitted wave will be circularly polarized with an electric-field vector rotating in the clockwise direction. Similarly, if the helix of antenna element 110 has counterclockwise turns, the transmitted wave will be circularly polarized with an electric-field vector rotating in the counterclockwise direction. The electromagnetic wave is propagated in a direction along the longitudinal axis of the antenna element 120. The electromagnetic wave has a frequency substantially equal to the frequency of the current produced by the power source 140.

Although the proceeding discussion is based on the perspective of the antenna system used to transmit electromagnetic waves, the antenna system can also be used to receive electromagnetic waves and the above-discussed principles are analogously applicable. For example, as used to receive electromagnetic waves, the antenna element 120 can establish an electromagnetic field within the interior portion 113 of the cavity member 110 based on the received electromagnetic wave. The electromagnetic field established within the interior portion 113 of the cavity member 110 can then be coupled into the driver element 130 to produce a signal. This signal can then be sent to receiver components (not shown) for processing. In other words, for use with a receiver system, the antenna system 100 would have receiver components substituted for the power source 140 shown in FIG. 3. The use of the term "driver element" includes configurations of the antenna system used as a transmitter (where the driver element establishes an electromagnetic field based on current received from the coupled power source) and as a receiver (where the driver element produces a current to receiver components based on the electromagnetic wave received by the antenna element).

Note that the antenna element 120 is a passive element and that the driver element 130 is the active element. In other words, the power source drives the driver element unlike typical known systems where the antenna element is driven directly. The antenna element 120 is passive in the sense that it is not directly driven with a current from the power source 140.

Because the antenna element 120 is a passive element, the quality factor (also referred to as "Q") is greater than would be the case if the antenna element 120 was an active element. Quality factor is a figure-of-merit representative of the antenna losses. Generally, the quality factor is proportional to energy storage divided by the power loss. Consequently, a high quality factor is allows the antenna system 100 to operate with a more narrow bandwidth. This can be applicable for such communications applications as cellular telephony receivers with a predetermined narrow operational bandwidth so that a broadband antenna system is not required. The antenna system 100 also provides narrow directivity due to the structure of the cavity member 110 acting as a cylindrical waveguide in establishing an electromagnetic field that couples to the passive antenna element 120.

Figure 6:
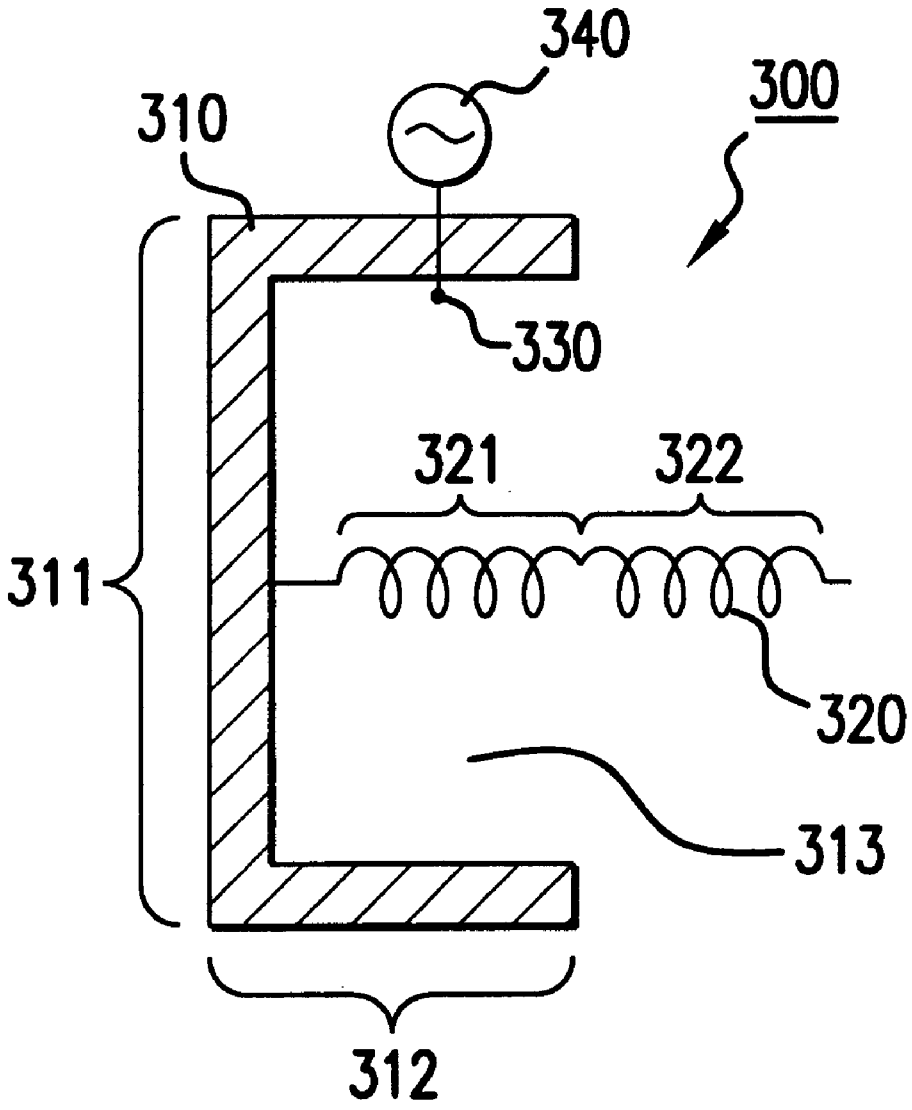
FIG. 6 illustrates a cross-sectional view of an antenna system, according to yet another embodiment of the present invention.

FIG. 6 illustrates a cross-sectional view of an antenna system having a two portion antenna element, according to an embodiment of the present invention. Antenna system 300 has a cavity member 310, antenna element 320, a driver element 330 and a power source 340. Cavity member 310 includes back portion 311 and wall portion 312 which define interior portion 313.

Antenna element 320 includes a first helix 321 having turns in one direction (e.g., clockwise) and a second helix 322 having turns in the opposite direction (e.g., counterclockwise). The first helix 321 is co-linear with the second helix 322. In the context of the antenna system 300 used with a transmitter system, as the electromagnetic field is coupled into the antenna element 320, the electromagnetic wave transmitted has one component that is circularly polarized in one direction (e.g., clockwise) and a second component that is circularly polarized in an opposite direction (e.g., counterclockwise). Of course, two co-linear circularly polarized waves at the same carrier rotating in opposite directions superpose to a linear wave.

Figure 7:
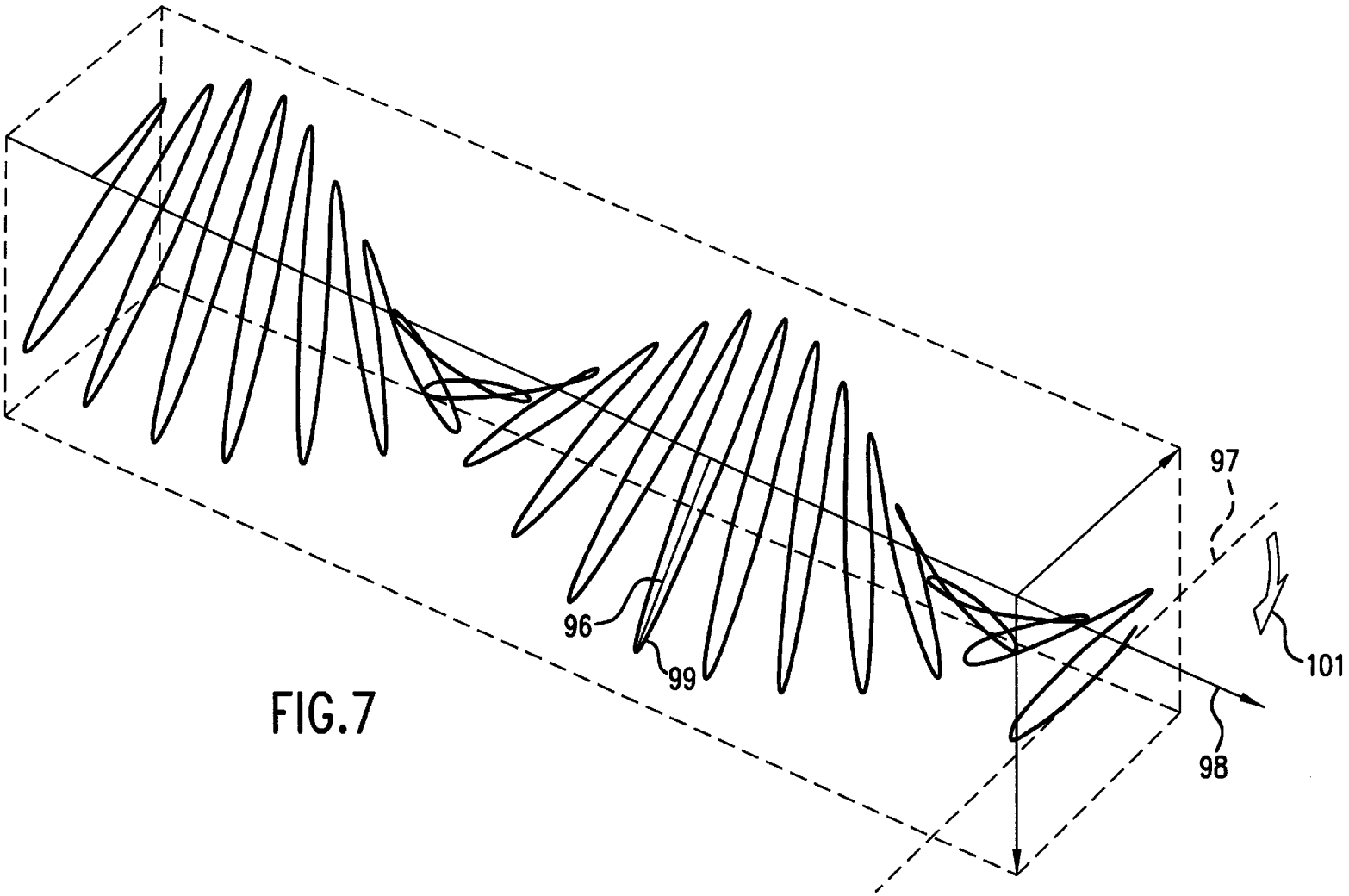
FIG. 7 illustrates a perspective view of a path traced by the terminus of the electric field vector for an electromagnetic wave transmitted and/or received by the embodiments of the present invention shown in FIGS. 8 and 10.

In other embodiments of the antenna system, the antenna system can be configured to transmit or receive electromagnetic waves other than circularly polarized, linearly polarized or elliptically polarized. For example, U.S. patent application Ser. No. 09/064,525, entitled "Communications System" and filed on Apr. 23, 1998 describes (and is specifically incorporated by reference) a communications receiver system that transmits and receives an electromagnetic wave having a carrier frequency and an electric field vector the terminus of which traces a nonlinear path at a second frequency between the carrier frequency and zero. The nonlinear period path of these waves can, for example, establish a communications channel; these waves can also carry information modulated onto signals generated in the process of transmitting the waves. FIG. 7 illustrates a perspective view of a path traced by the terminus of the electric field vector for an electromagnetic wave transmitted and/or received by the embodiments of the present invention shown in FIGS. 8 and 10.

Figure 8:
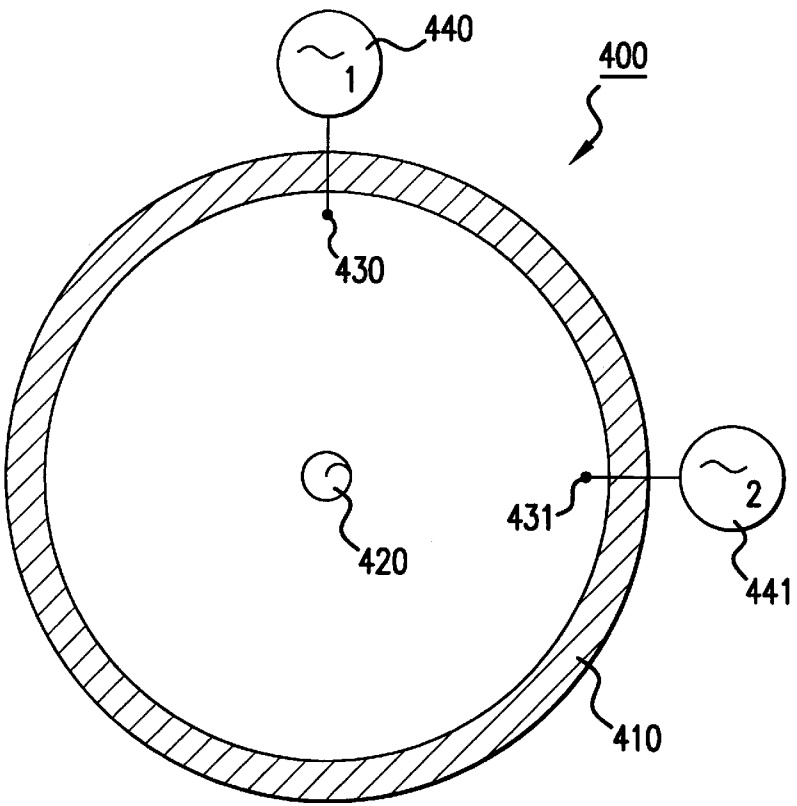
FIG. 8 illustrates an end view of an antenna system having multiple driver elements, according to another embodiment of the present invention.

FIG. 8 illustrates an end view of an antenna system having multiple driver elements, according to another embodiment of the present invention. Antenna system 400 includes a cavity member 410, antenna element 420, the driver elements 430 and 431, and the power sources 440 and 441. The passive antenna element 420 can include a first helix having turns in one direction (e.g., clockwise) and a co-linear second helix having turns in the opposite direction (e.g., counterclockwise). The helix and the second helix are co-linear in the sense that both have substantially aligned longitudinal axes. Driver elements 430 and 431 arc connected to power sources 440 and 441, respectively. Driver elements 430 and 431 arc angularly positioned within the interior portion of the cavity member 410 separated by 90 degrees.

Figure 9:
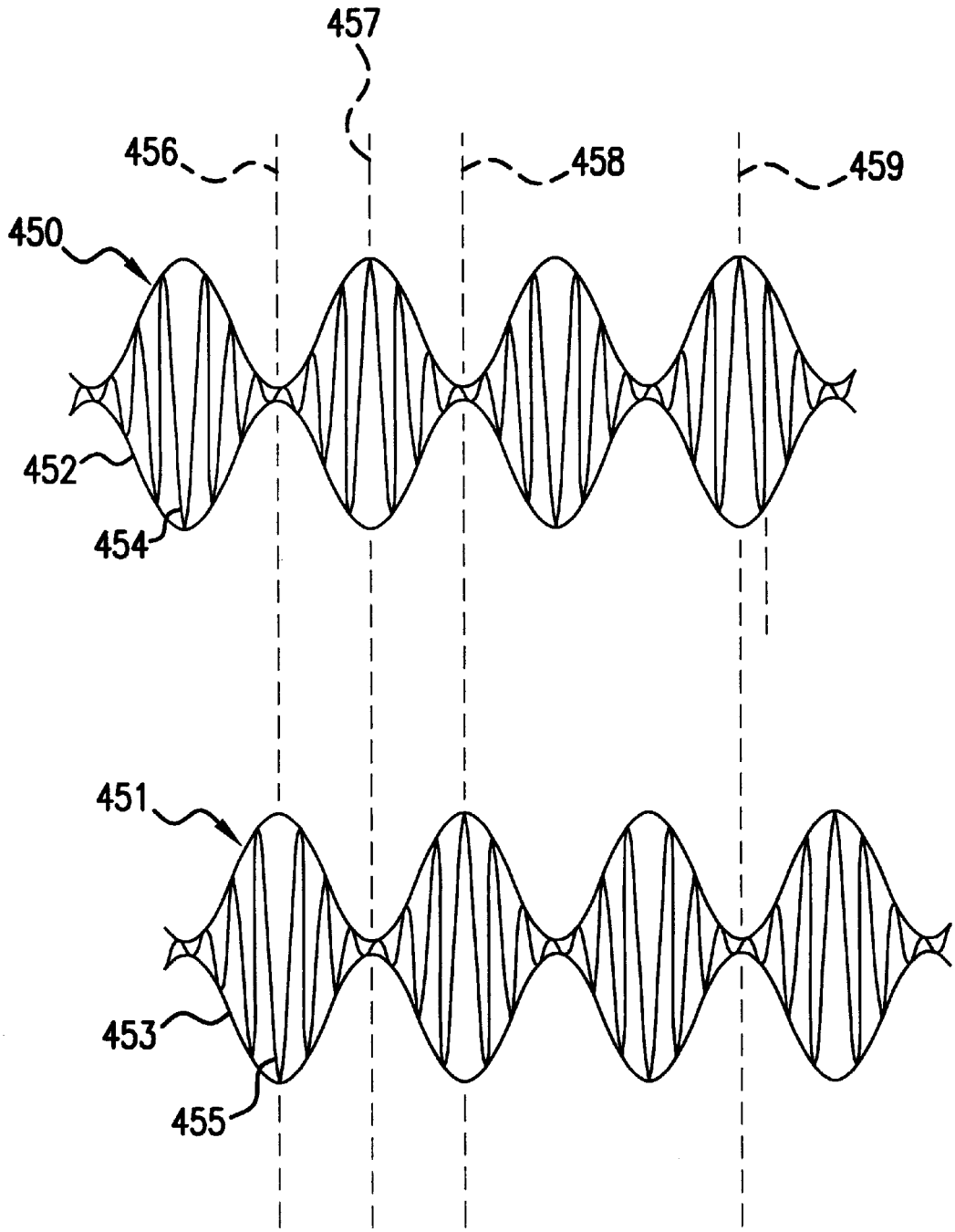
FIG. 9 illustrates examples of signals to be sent to the driver elements of the antenna system shown in FIG. 8 to generate the electromagnetic wave shown in FIG. 7.

The power sources 440 and 441 can drive driver elements 430 and 431, respectively, with currents that vary in relationship to the angular position of the driver elements 430 and 431 within the interior portion of the cavity member. More specifically, the electromagnetic waves shown in FIG. 7 can be generated by antenna system 400 (in a transmitter configuration) by driving the driver elements 430 and 431 with signals having an envelope 180 degrees out of phase. FIG. 9 illustrates examples of signals to be sent to the driver elements to generate the electromagnetic wave shown in FIG. 7.

Signals 450 and 451 have modulation envelopes 452 and 453, respectively, which are 180 degrees out of phase. Note for purposes of clarity that FIG. 9 is not to scale and therefore does not necessarily accurately reflect the relative sizes of the variations in information modulated signals 454 and 455 with respect to the modulation envelopes 452 and 453. Dashed lines 456, 457, 458 and 459 illustrate that the signals 450 and 451 are 180 degrees out of phase. For example, dashed line 456 is aligned to the maximum in the modulation envelope 452 of signal 450 and to the minimum in the modulation envelope 453 of signal 451. Both signals 450 and 451 contain information modulation signals 454 and 455, respectively, which are in phase.

The effect driving the driver elements 430 and 431 with the signals 450 and 451, respectively, which have envelopes out of phase with each other based on the angular separation of driver elements 430 and 431 within the cavity member 410, is that of establishing an electromagnetic field with a sweeping orientation. This electromagnetic field with a sweeping orientation can then coupled into the antenna element 420 to generate the an electromagnetic wave similar to that shown in FIG. 7.

Figure 10:
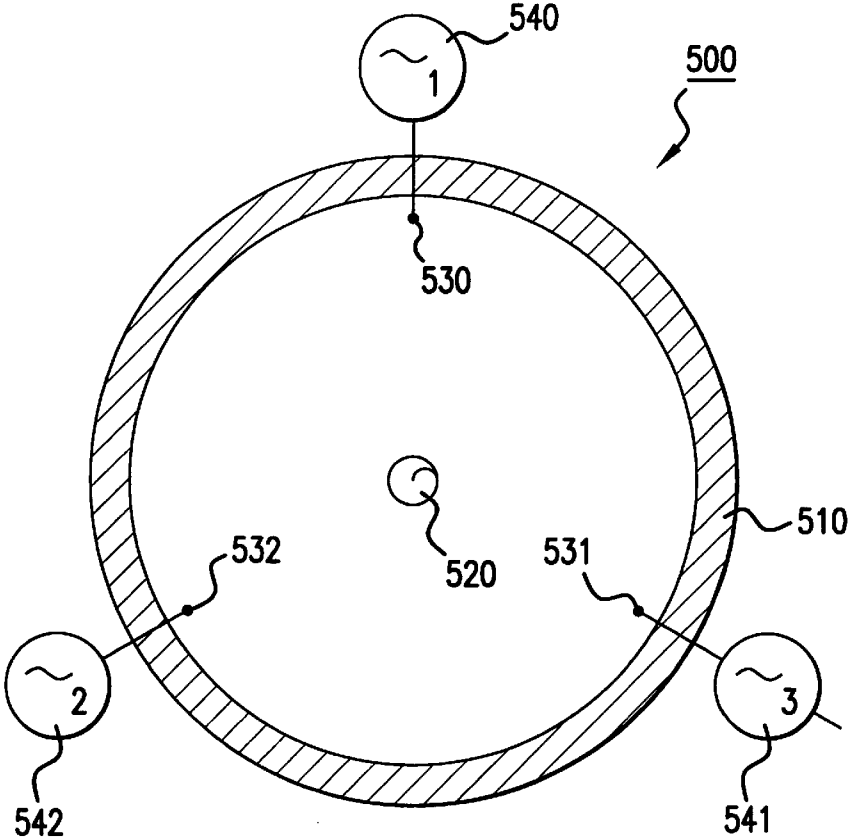
FIG. 10 illustrates an end view of an antenna system having multiple driver elements, according to another embodiment of the present invention.

FIG. 10 illustrates an end view of an antenna system having multiple driver elements, according to another embodiment of the present invention. Antenna system 500 includes a cavity member 510, antenna element 520, the driver elements 530, 531 and 532, and the power sources 540, 541 and 542. Again, the passive antenna element 520 can include a first helix having turns in one direction (e.g., clockwise) and a co-linear second helix having turns in the opposite direction (e.g., counterclockwise). Driver elements 530, 531 and 532 are connected to power sources 540, 541 and 542, respectively. Driver elements 530, 531 and 532 are angularly positioned within the interior portion of the cavity member 510 separated by 120 degrees.

Figure 11:
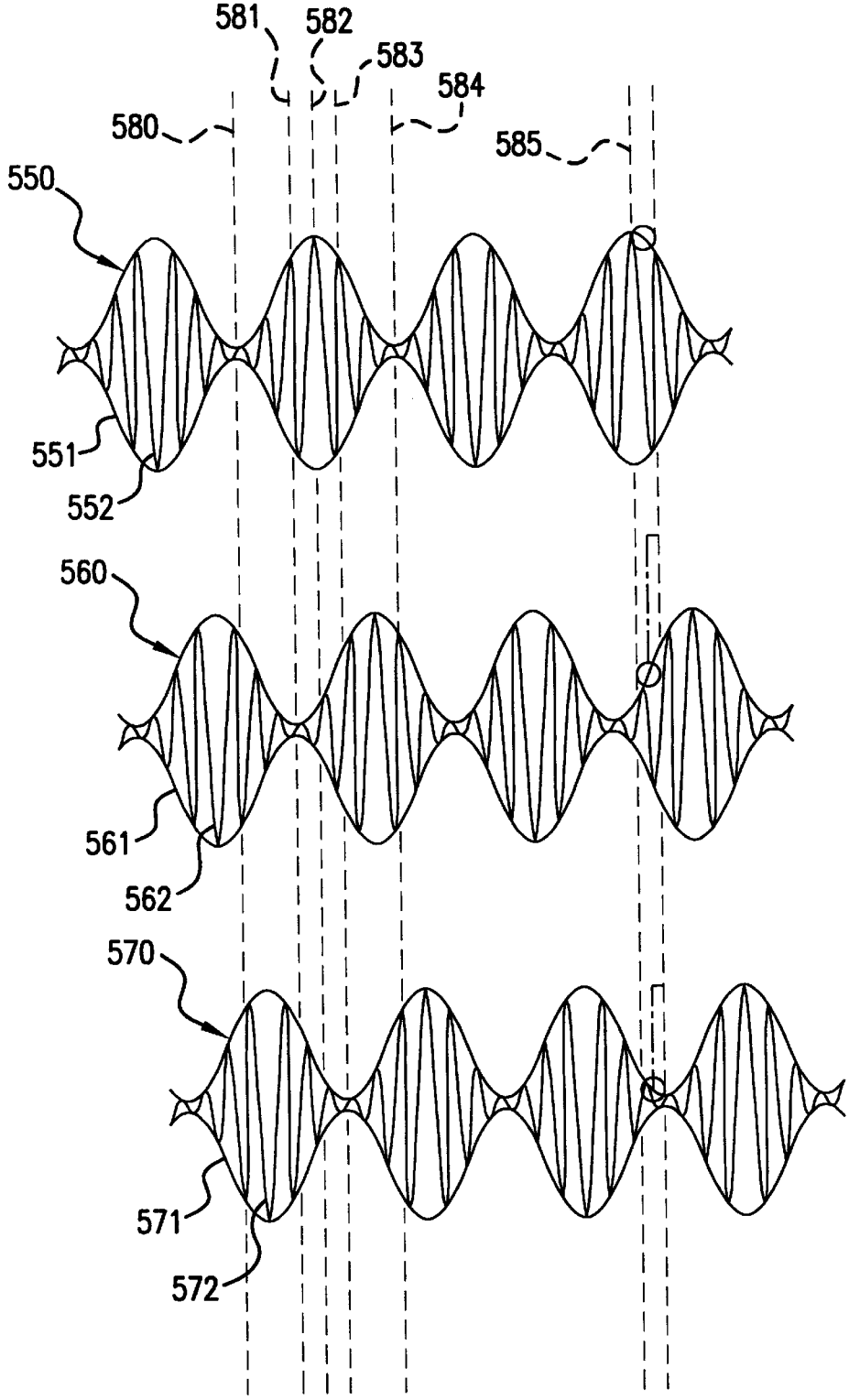
FIG. 11 illustrates examples of signals to be sent to the driver elements of the antenna system shown in FIG. 10 to generate the electromagnetic wave shown in FIG. 7.

The electromagnetic waves shown in FIG. 7 can be generated by antenna system 500 (in a transmitter configuration) by driving the driver elements 530, 531 and 532 with signals having an envelope 120 degrees out of phase similar to the discussion above with respect to FIG. 8 (where the antenna system has two driver elements 90 degrees apart). FIG. 11 illustrates examples of signals to be sent to the driver elements to generate the electromagnetic wave shown in FIG. 7.

Signals 550, 560 and 570 have modulation envelopes 551, 561 and 571, respectively, which are 120 degrees out of phase. Note for purposes of clarity that FIG. 11 is not to scale and therefore does not necessarily accurately reflect the relative sizes of the variations in information modulated signals 552, 562 and 572 with respect to the modulation envelopes 551, 561 and 571, respectively. Dashed lines 580 through 585 illustrate that the signals 550, 560 and 570 are 120 degrees out of phase. For example, dashed line 580 can represents a zero phase reference point so that dashed line 581 indicates a 120 phase shift. Dashed lines 582 and 584 indicate a 180 degree and 360 degree phase shift from the reference dashed line 580. Dashed line 583 indicates a 240 degree phase shift from the reference dashed line 580. All three signals 550, 560 and 570 contain information modulation signals 552. 562 and 572, respectively, which are in phase.

The effect driving the driver elements 530, 531 and 532 with the signals 550, 560 and 570, respectively, which have envelopes out of phase with each other based on the angular separation of driver elements 530, 531 and 532 within the cavity member 510, is that of establishing an electromagnetic field with a sweeping orientation. This electromagnetic field with a sweeping orientation can then be coupled into the antenna element 520 to generate the an electromagnetic wave similar to that shown in FIG. 7.

As the embodiments shown in FIGS. 8 and 10 illustrate, the antenna system can have any number of driver elements where the corresponding signals driven by the various driver elements have a phase relationship corresponding to the angular separation between the driver elements.

It should, of course, be understood that while the present invention has been described in reference to particular component shapes and configurations, other component shapes and configurations should be apparent to those of ordinary skill in the art. For example, the back portion of the cavity member need not be exactly circular. Other shapes can be possible, such as a square-like cross-sectional shape with rounded comers, so long as a cavity member can act as a cylindrical waveguide producing the fundamental mode at the wavelengths of operation. Moreover, although embodiments having multiple driver elements are discussed above as having two or three driver elements, other embodiments can have more driver elements, for example, nine elements.

What is claimed is:

1. An antenna for receiving or transmitting an electromagnetic wave having a carrier frequency and an electric field vector the terminus of which traces a nonlinear path at a frequency between the carrier frequency and zero, comprising:

a cavity member having a back portion and a wall portion that define a substantially cylindrical interior portion;

a plurality of driver elements disposed within the interior portion, the plurality of driver elements being arranged in an angular position around a propagation axis and substantially coplanar with a plane perpendicular to the propagation axis; and a director element having a longitudinal axis substantially parallel with the propagation axis, and having a proximal end disposed within the interior portion of the cavity member and a distal end protruding from the interior portion of the cavity member.

2. The antenna of claim 1, wherein the longitudinal axis of the director element is substantially axially aligned with the propagation axis.

3. The antenna of claim 1, wherein the director element comprises:

a first helical element having, windings in a first direction and having a first proximal end and a first distal end, the first proximal end coupled to the back portion of the cavity member; and a second helical element having windings in a second direction, opposite that of the first direction, and having a second proximal end and a second distal end, the second proximal end connected to the first distal end of the first helical element.

4. The antenna of claim 1, wherein the director element comprises:

a first spiral element having windings in a first direction and having a first proximal end and a first distal end, the first proximal end coupled to the back portion of the cavity member; and a second spiral element having windings in a second direction, opposite that of the first direction, and having, a second proximal end and a second distal end, the second proximal end connected to the first distal end of the first spiral element.

5. The antenna of claim 1, wherein:

the length of the wall portion of the cavity member is substantially a quarter wavelength at a center frequency of operation; and the diameter of the back portion of the cavity member is substantially a half wavelength at the center frequency of operation.

6. The antenna of claim 1, wherein the driver elements are loop probes coupled to the back portion of the cavity member.

7. The antenna of claim 1, wherein the driver elements are stub probes coupled to the wall portion of the cavity member.

8. The antenna of claim 1, wherein each of the plurality of driver elements are driven with a current having a phase based on the angular position of each driver element within the interior portion of the cavity member.

9. The antenna of claim 1, wherein a difference of phase for currents driving two adjacent driver elements equals an angular difference between the two adjacent driver elements within the cavity member.

10. The antenna of claim 1, wherein the plurality of driver elements comprise at least two driver elements.

11. The antenna of claim 1, wherein the plurality of driver elements comprise two driver elements, the driver elements having an angular spacing of ninety degrees about the propagation axis.

12. The antenna of claim 1, wherein the plurality of driver elements comprise at least three driver elements.

13. The antenna of claim 1, wherein the plurality of driver elements have substantially equal angular spacing about the propagation axis.

14. A method of transmitting an electromagnetic wave from a cavity antenna system, the system having a cavity member defining a substantially cylindrical interior portion, a plurality of driver elements disposed within the interior portion, the plurality of driver elements being arranged in an angular position around a propagation axis and substantially coplanar with a plane perpendicular to the propagation axis, and a director element having a longitudinal axis substantially parallel with the propagation axis and having a proximal end disposed within the interior portion of the cavity member and a distal end protruding from the interior portion of the cavity member, the method comprising:

driving the driver elements with signals having envelopes out of phase with each other based on the angular separation of the driver elements within the interior portion of the cavity member to generate an electromagnetic wave having a carrier frequency and an electric field vector the terminus of which traces a nonlinear path at a frequency between the carrier frequency and zero;

coupling the electromagnetic wave from the interior portion of the cavity member into the director; and transmitting the electromagnetic wave from the cavity antenna system.

15. The method of claim 14, wherein the plurality of driver elements comprises at least two driver elements.

16. The method of claim 14, wherein the plurality of driver elements comprises at least three driver elements.

17. The antenna of claim 14, wherein each of the plurality of driver elements are driven with a current having a phase based on the angular position of each driver element within the interior portion of the cavity member.

18. The antenna of claim 14, wherein a difference of phase for currents driving two adjacent driver elements equals an angular difference between the two adjacent driver elements within the cavity member.

19. A method of receiving an electromagnetic wave having a carrier frequency and an electric field vector the terminus of which traces a nonlinear path at a frequency between the carrier frequency and zero, the method comprising:

receiving at a cavity antenna system the electromagnetic wave, the cavity antenna system having a cavity member defining a substantially cylindrical interior portion, a plurality of driving elements disposed within the interior portion, the plurality of driving elements being arranged in an angular position around a propagation axis and substantially coplanar with a plane perpendicular to the propagation axis, and a director element having a longitudinal axis substantially parallel with the propagation axis and having a proximal end disposed within the interior portion of the cavity member and a distal end protruding from the interior portion of the cavity member;

coupling the electromagnetic wave from the director element to the interior portion of the cavity member; and driving the driving elements with the coupled electromagnetic wave.

20. The method of claim 19, wherein the plurality of driver elements comprises at least two driver elements.

21. The method of claim 19, wherein the plurality of driver elements comprises at least three driver elements.

22. The antenna of claim 19, wherein each of the plurality of driver elements are driving with a current having a phase based on the angular position of each driver element within the interior portion of the cavity member.

23. The antenna of claim 19, wherein a difference of phase for currents driving two adjacent driver elements equals an angular difference between the two adjacent driver elements within the cavity member.

* * * * *